United States Patent [19]

Burke et al.

[11] Patent Number: 4,896,164

[45] Date of Patent: Jan. 23, 1990

[54] RADAR TRANSPARENT WINDOW FOR COMMERCIAL BUILDINGS

[75] Inventors: Charles Burke, Melbourne; Joao F. I. Falcao, Palm Bay, both of Fla.; Albert R. Sarraffe, Bayshore; Michael T. Curtin, Bellerose, both of N.Y.

[73] Assignee: Grumman Aerospace Corporation, Bethpage, N.Y.

[21] Appl. No.: 238,080

[22] Filed: Aug. 30, 1988

[51] Int. Cl.[4] ..... H01Q 1/42

[52] U.S. Cl. ..... 343/872; 343/720

[58] Field of Search ..... 343/872, 720

[56] References Cited

U.S. PATENT DOCUMENTS

| | | | |
|---|---|---|---|
| 2,872,678 | 2/1959 | Braund | 343/720 |
| 2,932,806 | 4/1960 | Burr, Jr. | 333/252 |
| 2,971,172 | 2/1961 | Hamilton et al. | 333/252 |
| 2,978,704 | 4/1961 | Cohen et al. | 343/872 |
| 3,251,618 | 5/1966 | Kuehne, et al. | 333/252 |
| 3,387,237 | 6/1968 | Cook | 333/252 |
| 3,400,401 | 9/1968 | Shaw | 343/720 |
| 3,832,715 | 8/1974 | Afifi et al. | 343/872 |
| 4,536,998 | 8/1985 | Matteucci et al. | 52/171 |
| 4,661,821 | 4/1987 | Smith | 343/872 |
| 4,710,778 | 12/1987 | Radov | 343/872 |

*Primary Examiner*—Rolf Hille
*Assistant Examiner*—Doris J. Johnson
*Attorney, Agent, or Firm*—Pollock, VandeSande & Priddy

[57] ABSTRACT

A radar-transparent window may be architecturally and structurally mounted within the walls of a building to optically conceal the space behind the window while freely allowing signal transmission between an interior radar antenna and remotely situated radar target. The window in its basic form includes inner and outer layers typically fabricated from a polyester resin/E-Glass laminate while a core layer is present which may be comprised of a rigid polyimide foam.

2 Claims, 1 Drawing Sheet

RADAR TRANSPARENT WINDOW FOR COMMERCIAL BUILDINGS

FIELD OF THE INVENTION

The present invention relates to radome-like structures, and more particularly to a radar-transparent window for commercial buildings.

BACKGROUND OF THE INVENTION

Newly developed radar antennas must be tested to determine their performance. This is most often done in a laboratory environment where the antenna may be connected to sophisticated electronic measurement instrumentation. Since a line of sight between the radar antenna and target must be present, an unsightly and costly temporary fiberglass radome-like structure must be constructed on the exterior of a laboratory building. Another alternative is to install roll-up steel doors. As will be appreciated, this is an aesthetically unacceptable choice where the architectural appearance of the laboratory building is of importance.

BRIEF DESCRIPTION OF THE INVENTION

The present invention provides a large radar-transparent window which may be made to conform to the external architecture of a commercial or industrial building while being structurally equivalent to what might normally be a glass pane. It provides a satisfactory electrical interface for antenna systems to be checked out and tested by instrumentation within a laboratory environment while the antenna structure faces outwards into an unobstructed physical environment. It provides an alternative to the use of unsightly air-inflatable radomes, fiberglass structures, or roll-up steel doors which would normally be employed in a building for these purposes.

The radar window will enhance the security of a radar development because it will not indicate to the casual observer that there is sensitive equipment in the building that requires a radar-transparent or electrically transparent medium to operate or radiate to the exterior of the building.

The radar window of the present invention can be electrically designed to meet the antenna requirements and may be structurally designed to satisfy the architecture of a commercial building. It can conceivably be molded into a shape other than a flat panel. If addressed as an integral part of the design of a building, the window could be either tilted or curved so as to provide a skyward look for satellite communications in an unobservable and secure environment.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
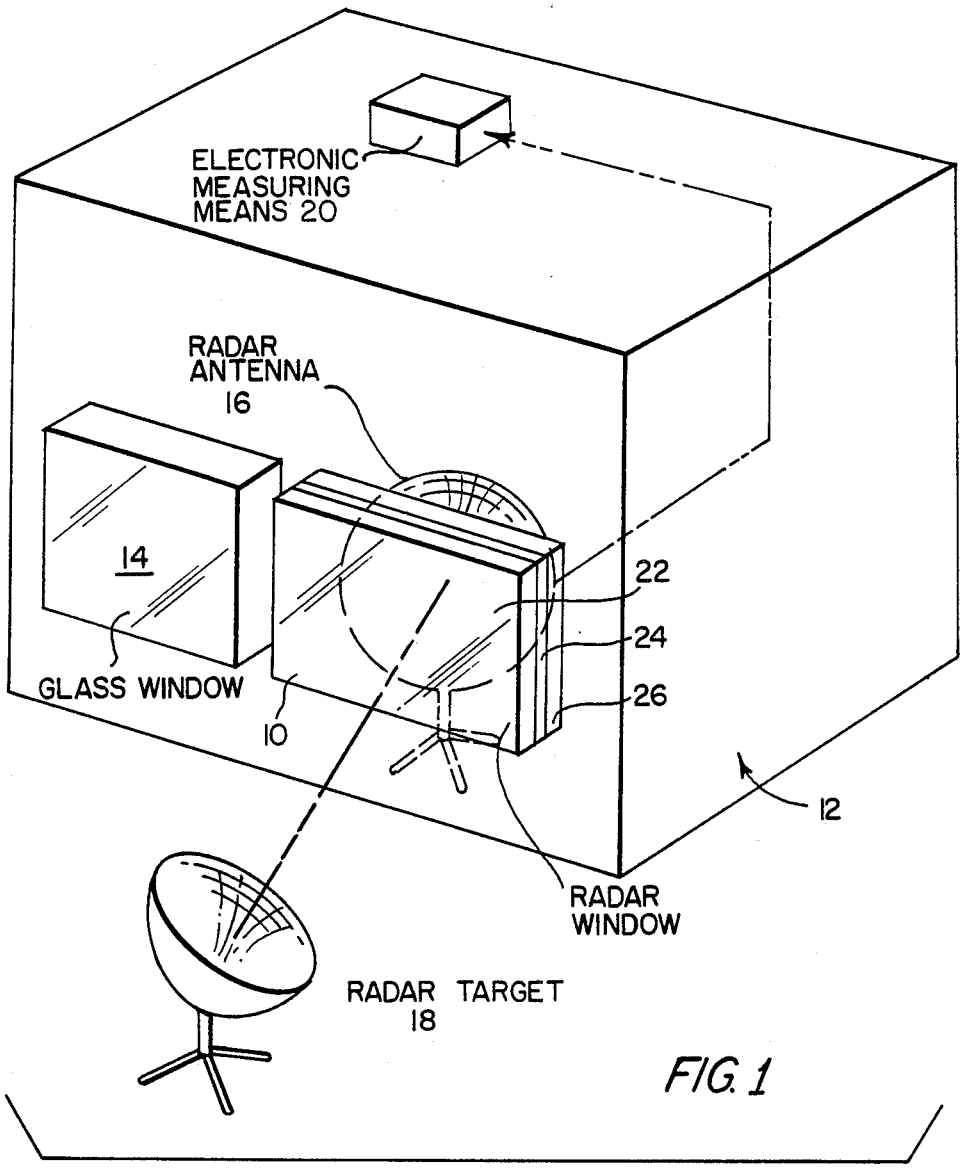
FIG. 1 is a schematic depiction of a radar window axially interposed between a radar target and a radar antenna undergoing testing.

The purpose of the present invention will best be seen from FIG. 1 wherein a radar window 10, in accordance with the present invention, is shown installed on the exterior of a building and axially interposed between a radar antenna 16 undergoing testing within the building and an externally located radar target 18. The radar window 10, although not constructed of solid glass plate, is intended to present the same external architectural appearance as an ordinary glass window 14. However, unlike conventional glass windows, the radar window 10 prevents visual observation of the interior of the window because it is optically opaque. This is of great security benefit when the installation within the building is of a classified nature. It is important that the radar antenna 16 be housed internally of the building 12 so that precise and often necessarily complicated electronic measuring means 20 may be easily connected to the antenna 16. It is to be emphasized that the radar antenna 16 and measurement means 20 do not, per se, form part of the present invention. Rather, it is the unique and patentable inclusion of a radome-like structure, namely a radar window 10, in a commercial or industrial building which forms the heart of the present invention.

Figure 2:
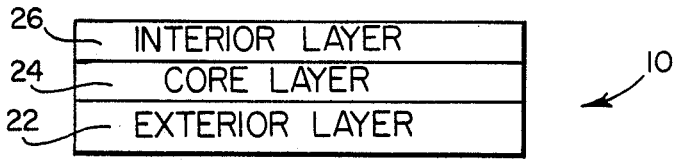
FIG. 2 is a schematic sectional view of the radar window.

FIG. 2 illustrates the basic cross-sectional construction of a window 10 in accordance with the present invention. The interior layer 26 may be of the same material as exterior layer 22. In a typical installation, this layer may be a polyester resin/E-Glass laminate which may be of the type commercially known as GM 4001 A. The layer may have a thickness of approximately 0.020 inch and a dielectric constant equal to 3.97. Such a layer has a loss tangent equal to 0.013. The core layer 24 may typically be a rigid polyimide foam such as the type carrying the conventional industrial designation Rohacell 71 WF and having a thickness approximately equal to 0.250 inch. Such a material typically has a dielectric constant equal to 1.11 and a loss tangent of 0.003. Although these materials are specified by way of example, they are not intended to be critical to the present invention. The actual selection of materials and thicknesses may be selected in accordance with known radome design considerations.

An epoxy adhesive may be employed to bond the various layers together. A non-limiting example of such an adhesive is a material industrially designated as GM4355 (AF 130). Such an adhesive has a dielectric constant of 3.35 and a loss tangent equal to 0.024.

By producing a laminated radar window in accordance with the present invention, there is made available a panel which is architecturally and structurally sound and in this respect may be used as would a comparably sized glass panel. Of course, in accordance with proper installation techniques, the edges of window 10 are preferably sealed against moisture and are installed in a window frame in the same manner as a conventional window.

As is the case with radomes, the present radar window may also be painted to match the color of other exterior architectural panels. For example, an exterior finish might be a white polyurethane paint such as defined by military specification MIL-C-83286. The thickness of the radar window and the paint must be considered for achieving a "tuned" panel in accordance with radome design.

According to the previous description of the invention, it will be appreciated that an architectural panel may be made available which optically conceals the space behind the window while freely allowing transmission of radar signals from a building-enclosed radar antenna to a remote field target. It is to be noted that glass windows cannot be successfully used to achieve the purposes of the present invention because glass is highly reflective and also greatly attenuates radar signal transmission therethrough.

It should be understood that the invention is not limited to the exact details of construction shown and described herein for obvious modifications will occur to persons skilled in the art.

We claim:

1. A building structure comprising:

a plurality of structural walls;

an opening formed in at least one of the walls;

multi-layered panel means mounted in the opening for permitting transparent radar transmission therethrough while optically obscuring the interior space behind the panel, the panel means comprising:

an inner layer of polyester resin/E-glass laminate;

an outer layer of polymide resin/E-glass laminate having a light reflective exterior surface resembling window pane glass; and at least one core layer of rigid polyimide foam.

2. The structure set forth in claim 1 wherein the outer layer surface is painted.

* * * * *

UNITED STATES PATENT AND TRADEMARK OFFICE

CERTIFICATE OF CORRECTION

PATENT NO. : 4,896,164

DATED : January 23, 1990

INVENTOR(S) : Charles Burke, et al.

It is certified that error appears in the above-identified patent and that said Letters Patent is hereby corrected as shown below:

Column 4, line 8, change "polymide" to --polyimide--.

Signed and Sealed this

Fifth Day of March, 1991

*Attest:*

HARRY F. MANBECK, JR.

*Attesting Officer*

*Commissioner of Patents and Trademarks*